US007617816B1

(12) United States Patent
Orr et al.

(10) Patent No.: US 7,617,816 B1
(45) Date of Patent: Nov. 17, 2009

(54) LOW PRESSURE RAM ASSEMBLY

(76) Inventors: Jeffrey G. Orr, 3779 Trinity Cir., Corona, CA (US) 92881; Antonio Nava, 3984 Davidson St., Corona, CA (US) 92879; Lee Ourn, 1605 Hardt St., Loma Linda, CA (US) 92354

( * ) Notice: Subject to any disclaimer, the term of this patent is extended or adjusted under 35 U.S.C. 154(b) by 560 days.

(21) Appl. No.: 11/518,788

(22) Filed: Sep. 11, 2006

(51) Int. Cl.
*F41B 11/00* (2006.01)

(52) U.S. Cl. ..... 124/31; 124/73

(58) Field of Classification Search ..... 42/69.01; 124/31, 32, 34, 73–77
See application file for complete search history.

(56) References Cited

U.S. PATENT DOCUMENTS

| | | | | |
|---|---|---|---|---|
| 3,788,298 | A | 1/1974 | Hale | 124/11 |
| 4,147,152 | A | 4/1979 | Fischer et al. | 124/76 |
| 4,531,503 | A | 7/1985 | Shepherd | 124/76 |
| 4,770,153 | A | 9/1988 | Edelman | 124/72 |
| 4,936,282 | A | 6/1990 | Dobbins et al. | 124/74 |
| 5,063,905 | A | 11/1991 | Farrell | 124/72 |
| 5,462,042 | A | 10/1995 | Greenwell | 124/76 |
| 5,505,188 | A | 4/1996 | Williams | 124/74 |
| 5,515,838 | A | 5/1996 | Anderson | 124/76 |
| 5,613,483 | A | 3/1997 | Lukas et al. | 124/73 |
| 5,878,736 | A | 3/1999 | Lotuaco, III | 124/71 |
| 5,881,707 | A | 3/1999 | Gardner, Jr. | 124/77 |
| 5,957,119 | A | 9/1999 | Perry et al. | 124/73 |
| 5,967,133 | A | 10/1999 | Gardner, Jr. | 124/77 |
| 6,003,504 | A | 12/1999 | Rice et al. | 124/73 |
| 6,035,843 | A | 3/2000 | Smith et al. | 124/77 |
| 6,065,460 | A | 5/2000 | Lotuaco, III | 124/72 |
| 6,138,656 | A | 10/2000 | Rice et al. | 124/73 |
| 6,349,711 | B1 | 2/2002 | Perry et al. | 124/73 |
| 6,439,217 | B1 | 8/2002 | Shih | 124/77 |
| 6,474,326 | B1 | 11/2002 | Smith et al. | 124/77 |
| 6,532,949 | B1 | 3/2003 | McKendrick | 124/77 |
| 6,553,983 | B1 | 4/2003 | Li | 124/73 |
| 6,561,176 | B1 | 5/2003 | Fujimoto et al. | 124/76 |
| 6,578,566 | B2 | 6/2003 | Hernandez | 124/73 |
| 6,626,165 | B1 | 9/2003 | Bhogal | 124/77 |
| 6,637,420 | B2 | 10/2003 | Moritz | 124/73 |
| 6,637,421 | B2 | 10/2003 | Smith et al. | 124/77 |
| 6,644,295 | B2 | 11/2003 | Jones | 124/77 |
| 6,658,982 | B2 | 12/2003 | Cherry | 89/1.42 |
| 6,715,480 | B2 | 4/2004 | Dziob | 124/73 |
| 6,810,871 | B2 | 11/2004 | Jones | 124/77 |
| 6,973,748 | B2 | 12/2005 | Rice | 42/69.01 |

FOREIGN PATENT DOCUMENTS

RU 2210049 C1 * 8/2003

* cited by examiner

*Primary Examiner*—Troy Chambers
(74) *Attorney, Agent, or Firm*—Keisling Pieper & Scott PLC; Meredith K. Lowry; Trent C. Keisling

(57) ABSTRACT

The present invention provides a trigger assembly for a paintball marker utilizing compressed gas. The trigger assembly includes an air assist trigger mechanism further providing exhaust gas to a ram assembly for recocking the paintball marker.

13 Claims, 3 Drawing Sheets

LOW PRESSURE RAM ASSEMBLY

CROSS-REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

RESERVATION OF RIGHTS

A portion of the disclosure of this patent document contains material which is subject to intellectual property rights such as but not limited to copyright, trademark, and/or trade dress protection. The owner has no objection to the facsimile reproduction by anyone of the patent document or the patent disclosure as it appears in the Patent and Trademark Office patent files or records but otherwise reserves all rights whatsoever.

BACKGROUND OF THE INVENTION

1. Field of the Invention

The present invention relates to the field of paintball markers. In particular, the present invention relates specifically to a ram used for controlling the back block of a paintball marker. The ram provides pressure relief at the end of the ram's internal piston tube to reduce operating resistance and provide increased operating speed for the marker.

2. Description of the Known Art

The equipment used to fire paint balls are commonly referred to as paintball "markers". Markers launch the paint balls by releasing a burst of compressed gas (typically CO2, N2, or air) into a barrel behind the paintball projectile. Projectile launchers operated by means of a supply of pressurized gas have been known for quite some time and have been used to fire a variety of projectiles including pellets and small balls. In more recent years, gas operated markers have been developed and designed specifically to fire paint balls. The paint balls typically may comprise a mixture of a liquid including ethylene glycol with the liquid being encased in a fragile gelatin casing designed to break apart upon striking a target. The liquid will then mark the target that has been hit. These types of markers have a variety of different uses. Earlier uses involved tree marking in forestry projects and animal marking in conservation or farming projects. For example, the markers were originally used to segregate livestock within a herd, assist in the counting of wild animals or for training of military or law enforcement personnel through simulation exercises. Likewise, these markers may be used by military and law enforcement personnel for crowd control.

Another very popular use for such markers is recreation in the game of "paintball". In particular, paintball markers are used for "mock war games" in which participants dressed in protective gear attempt to hit other combatants with paint balls thereby marking them and eliminating them from the game.

As will be appreciated by those skilled in the art, a variety of different types of paint ball markers exist in the field using a variety of mechanisms for accomplishing their purpose of projecting paint balls. Patents disclosing information relevant to paintball markers include U.S. Pat. No. 3,788,298, issued to Hale on Jan. 29, 1974; U.S. Pat. No. 4,147,152, issued to Fisher et al. on Apr. 3, 1979; U.S. Pat. No. 4,531,503, issued to Shepard on Jul. 30, 1985; U.S. Pat. No. 5,462,042, issued to Greenwell on Oct. 31, 1995; U.S. Pat. No. 5,505,188, issued to Williams on Apr. 9, 1996; U.S. Pat. No. 5,515,838, issued to Anderson on May 14, 1996; U.S. Pat. No. 6,439,217, issued to Shih on Aug. 27, 2002; U.S. Pat. No. 6,553,983, issued to Li on Apr. 29, 2003; U.S. Pat. No. 6,561,176, issued to Fujimoto et al. on May 13, 2003; U.S. Pat. No. 6,578,566 issued to Hernandez on Jun. 17, 2003; U.S. Pat. No. 6,658, 982 issued to Cherry on Dec. 9, 2003; U.S. Pat. No. 6,637, 420, issued to Moritz on Oct. 28, 2003; and U.S. Pat. No. 6,715,480 issued to Dziob on Apr. 6, 2004. The entirety of each of these patents is hereby expressly incorporated by reference.

U.S. Pat. Nos. 3,788,298; 4,147,152; 4,531,503; and 5,505, 188 are typical of paint ball markers wherein the hammer and/or bolt are in a single barrel.

U.S. Pat. Nos. 5,462,042; 5,515,838; 6,553,983; and 6,561, 176 are typical of paintball markers wherein the marker body comprises two parallel tubular bores. The upper bore contains the bolt, while the lower bore contains the hammer. The bolt and hammer components are connected together, allowing their moving parts to move in concert. The bolt and hammer assembly is held in the reset position via a trigger sear, which catches the hammer portion of the assembly. In this position the breach is open and a paint ball is able to drop into position in front of the bolt. When the trigger is pulled the sear releases the hammer and a spring drives the hammer and bolt forward. As the bolt moves forward the hammer simultaneously moves forward to strike a poppet valve as the bolt closes on the chamber. The poppet valve releases a burst of high pressure gas into and through the bolt expelling the paint ball from the barrel. A bleed-off of the burst of high pressure gas then propels the hammer and bolt backwards. The hammer is then caught by the trigger sear and the marker is again in a reset configuration and ready to be fired again.

Another form of marker using two parallel tubular bores is shown in U.S. Pat. No. 6,637,420 wherein the hammer and bolt operate independently of each other. One attribute which is extremely important to users of paint ball markers which are intended for such recreational war games, as well as those used for other purposes, is the rate at which the marker may be fired. Obviously, markers which are capable of increased firing rates offer the user a significant competitive advantage over his/her fellow combatants. One significant factor which influences the firing rate of any weapon is the type of hammer and bolt assembly. Paint ball markers typically may employ manual, semi-automatic and fully automatic firing arrangements. As is well known, manual firing arrangement requires appropriate manipulation of the trigger before successive projectiles are fired. In contrast, a semi-automatic firing arrangement enables a projectile to fired and reset each time the trigger is depressed, while an automatic firing arrangement will fire multiple projectiles each time the trigger is pulled and held.

In paint ball markers that are semi-automatic, a new projectile is automatically loaded into firing position immediately after launch of a preceding paint ball. Such paint ball markers typically utilize a reciprocating bolt. The bolt serves two primary functions. First, the bolt cycles between a loading position in which the outlet of the projectile magazine is uncovered permitting a paint ball to drop into a breech, or bolt chamber, of the paint ball marker, and then to a launch position in which the bolt moves toward the muzzle or barrel of the marker covering the magazine outlet. Second, when in the "launch" position, the bolt re-directs a charge of compressed gas released from a chamber in the marker to propel the paint ball out the muzzle end of the barrel toward a target. The expanding gas of the propellant charge transfers energy to the projectile, expelling it from the barrel of the marker. It is the efficiency of this energy transfer that ultimately determines what quantity, i.e., pressure of propellant charge required to propel a paint ball at a given velocity.

For an automatic or semiautomatic marker using this independent bolt to hammer configuration, a three-way valve is used to direct compressed gas through a ram to reset the marker to be ready for the next firing. The operational speed of the three way valve and the ram directly affect the operational speed of the paintball marker. Continuing in the operational sequence, the trigger is further pulled past release of a sear so that a timing rod acts through a mechanical assembly to direct gas through the three-way valve to the ram that pushes the hammer and bolt rearward to the reset position. During the rearward movement, the hammer compresses a spring until the hammer is retained by engagement of a trigger sear in preparation for a next firing. The timing rod is adjustably connected to a coupler at the three-way valve to achieve correct timing. The effective length of the timing rod is precise to assure that gas is released at only the appropriate time to reset the marker. If the timing rod is set improperly, the reset occurs at the wrong time relative to the firing sequence, or not at all, and the marker fails to operate.

Variances in friction between the hammer and its chamber wall, whether caused by wear, dirt or the like, affect the magnitude and duration of hammer pressurization required to fully reset it. If friction is low, the hammer moves quickly and smoothly and the relevant volume of gas in the hammer chamber expands rapidly. Such rapid expansion may detract from the pressure used to discharge the projectile and projectile velocity is reduced. On the other hand, if friction is higher, the hammer may move more slowly, the volume of gas in the hammer chamber expands slowly and the primary valve is retained open for a longer period of time. As a consequence, substantially full input pressure continues to be applied to the projectile, notwithstanding that it is well down the barrel. This decreases the consistency and predictability of projectile velocity and thus effects the "dynamics" of projectile discharge such that projectile velocity may not be the same from shot to shot. As a result, the marker may require a different aiming point for each shot—this is a very annoying problem for the user.

To understand this invention, operation of paintball markers in general must be understood. FIG. 1 is presented to depict a paint ball maker 100 of the prior art. This prior art marker needs to be understood to aid in the description of the improved ram assembly as set forth in this invention.

As shown in FIG. 1, the basic marker 100 comprises a marker body 110 with an attached barrel 112, trigger assembly 114, and reset ram assembly 116. The reset ram assembly 116 includes a three-way valve 117 which is controlled by the trigger 153. A compressed gas supply, not shown, is connected to receiver 118 and regulator 119. The receiver 119 directs compressed gas through first line 115 to the reset ram assembly 116 from the three-way valve 117 attached to the marker body 110. A second line 113 is connected from the front of the valve 117 to the rear of the reset ram assembly 116. With these connections, the three-way valve 117 controls the position of the valve ram 152 within the reset ram assembly 116. The reset ram assembly 116 is connected by the valve ram 152 to the back block 142. The back block 142 is connected to the bolt 140 and has a limited sliding connection with the hammer reset rod 146. In this manner, the trigger controls the reset ram assembly 116 and the reset ram assembly 116 directly controls the position of the bolt 140 and influences the position of the hammer 128 through the valve ram 152.

The bolt 140 controls the loading of the paintball projectile 122 into the firing chamber 124. A paint ball projectile magazine 120 is mounted to the marker body 110 to supply paint ball projectiles 122. When the bolt 140 is in the rearward bolt loading position the paintball falls into the bolt chamber 124. The bolt 140 is then moved into the firing position as shown in FIG. 1.

The bolt 140 includes forward passage 141 which is sealed from passage 132 in the rearward or reset position. The bolt 140 may include appropriate o-ring seals, not numbered, to effectively create a piston effect to the bolt 140 as it reciprocates in the bolt chamber 124. When the bolt 140 is then moved into the firing position, the bottom opening of the forward passage 141 will be in alignment with passage 132 thereby directing compressed gas into chamber 124 to expel the paint ball 122. Now that bolt 140 movement is understood for chambering a paintball projectile 122, the release of the pressurized gas and reset of the marker will be understood through the motion of the hammer 128.

Parallel to the bolt chamber 124 is a hammer chamber 126 in which the prior art version of a hammer 128 is shown in the reset position 129 from which the hammer 128 reciprocates. A propellant storage chamber 130 receives compressed gas from the receiver 118 and regulator 119 via conduits, not shown, to supply compressed gas for propelling the paintball 122. The compressed gas in the storage chamber 130 is held back by the poppet valve 136 which is opened by movement of the exhaust valve pin 134. Once the valve 136 is opened, compressed gas travels through firing gas supply passage 132 and the bolt passage 141 into the bolt chamber 124 for discharging the paintball projectile 122. The firing valve 136 is normally held closed by firing valve spring 138.

Just as the back block 142 affects the position of the bolt 140 in the bolt chamber 124, the back block influences the position of the hammer 128 via the sliding connection of the reset rod 146 with the back block 142. In this prior art version 100 the reset rod 146 is fixably attached to the hammer 128 and has a sliding connection with the back block 142. When the hammer 128 is released, the pressure of spring 145 moves the hammer 128 forward and the reset rod 146 slides in the back block 142. An artificial limit may be imposed on the forward movement of the hammer 128 by limiting the movement with the flange 144 of the reset rod 146 striking the back block 142.

During the reset phase, the back block 142 normally returns the bolt 140 and contacts the flange 144 on the reset rod 146 to return the attached hammer 128 to the reset position shown in FIG. 1 by compressing spring 145 to the position as shown. The back block 142 and bolt 140 will then return to the firing position. This leaves the reset rod 146 extended.

When the three way valve 117 is in a first position, compressed gas is directed through the first ram connection 115 to the front side 101 of the internal piston 102 of the ram 116. This causes the internal piston of the ram 116 to move rearward and creates a pressure on the back side 103 of the internal piston 102. This back pressure causes compressed gas to form which travels back to the three way valve 117 through the second ram connection 113 to be exhausted through the exhaust port 104 in the three way valve 117. A similar situation occurs for the second side 103 of the ram 116, creating an exhaust gas passing out of the exhaust port 105 on the first side of the valve 117. This creation of additional pressures on the opposite side of the ram 116 from the incoming gas causes a resistance which is made even greater by the resistance of reversing the gas flow through the supply lines 113, 115 and the three way valve 117. This resistance causes a reduction in the speed at which the ram 116 may operate for the given pressures that are used in the marker 100. Thus, an improved design is needed to overcome this problem.

Thus, it may be seen that the prior art is very limited in their teaching and utilization, and an improved paintball marker is needed to overcome these limitations.

SUMMARY OF THE INVENTION

The present invention is directed to an improved paintball marker utilizing compressed gas. The paintball marker features an improved trigger assembly with an air assist trigger mechanism and a gas operated ram apparatus for use with compressed gas. Of note is the construction of the ram apparatus within the trigger assembly.

The ram is placed below the sear assembly and adapted to motivate the sear to engage the hammer. The ram includes a housing defining a central aperture encasing an internal piston coupled to an external connection. Within the central aperture, the internal piston defines a first side chamber and a second side chamber. The internal piston is movably sealed within the central aperture such that introduction of the compressed gas to the first side chamber creates movement in a first direction that results in second end compression resistance. This resistance biases the ram member further biasing the sear mechanism to engage the hammer. The remaining resistance is exhausted through a second end exhaust.

Objects and advantages of the present invention include direct venting of exhaust gases, reduced ram resistance, increased ram operating speed, increased operating speed for the paintball marker, and the elimination of return airflow resistance. These and other objects and advantages of the present invention, along with features of novelty appurtenant thereto, will appear or become apparent by reviewing the following detailed description of the invention.

BRIEF DESCRIPTION OF THE SEVERAL VIEWS OF THE DRAWINGS

In the following drawings, which form a part of the specification and which are to be construed in conjunction therewith, like reference numerals have been employed throughout wherever possible to indicate like parts in the various views.

DETAILED DESCRIPTION OF THE INVENTION

Figure 1:
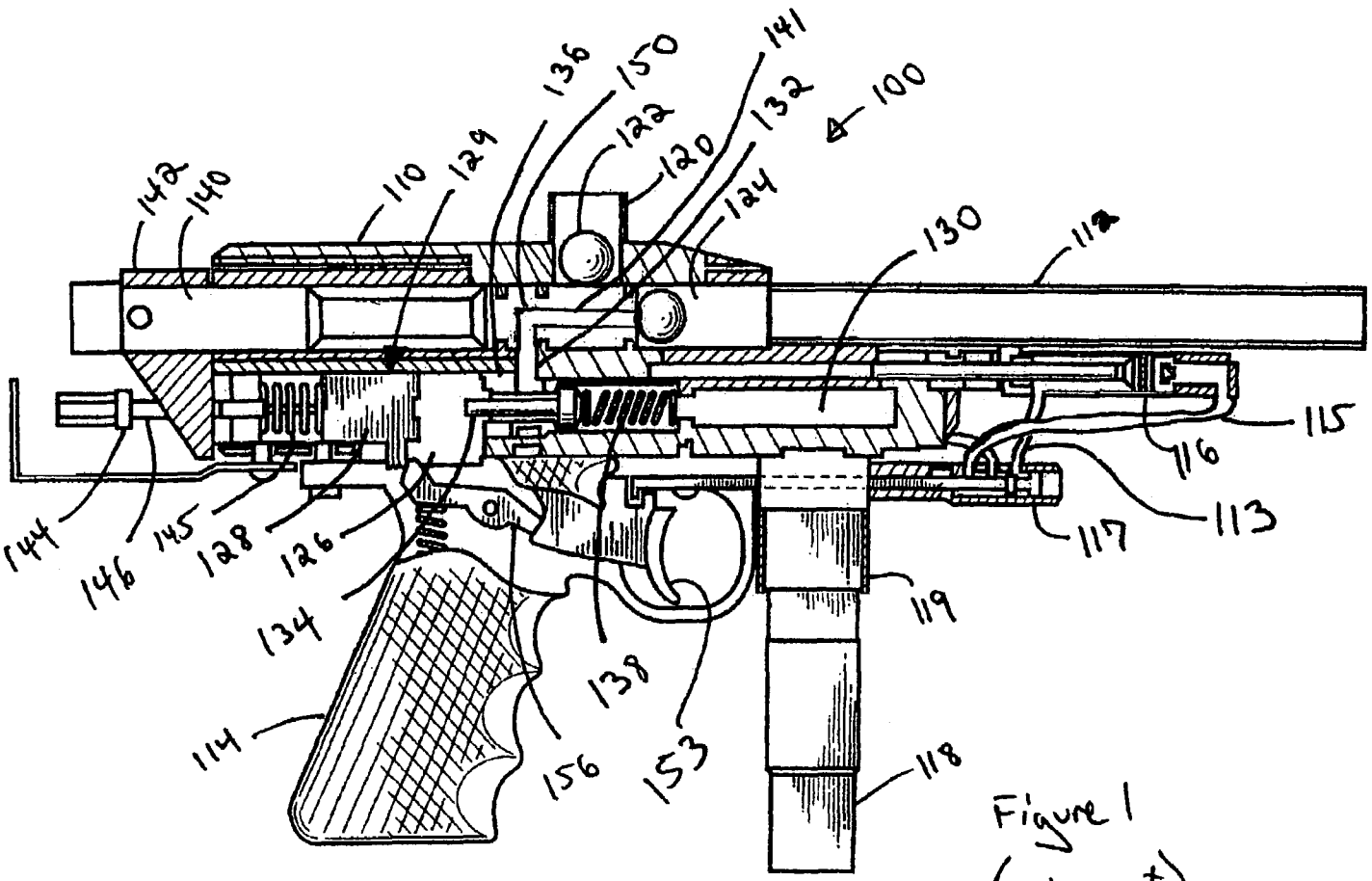
Figure 1 (prior art)
FIG. 1 displays a schematic view of the prior art paintball marker.
Figure 2:
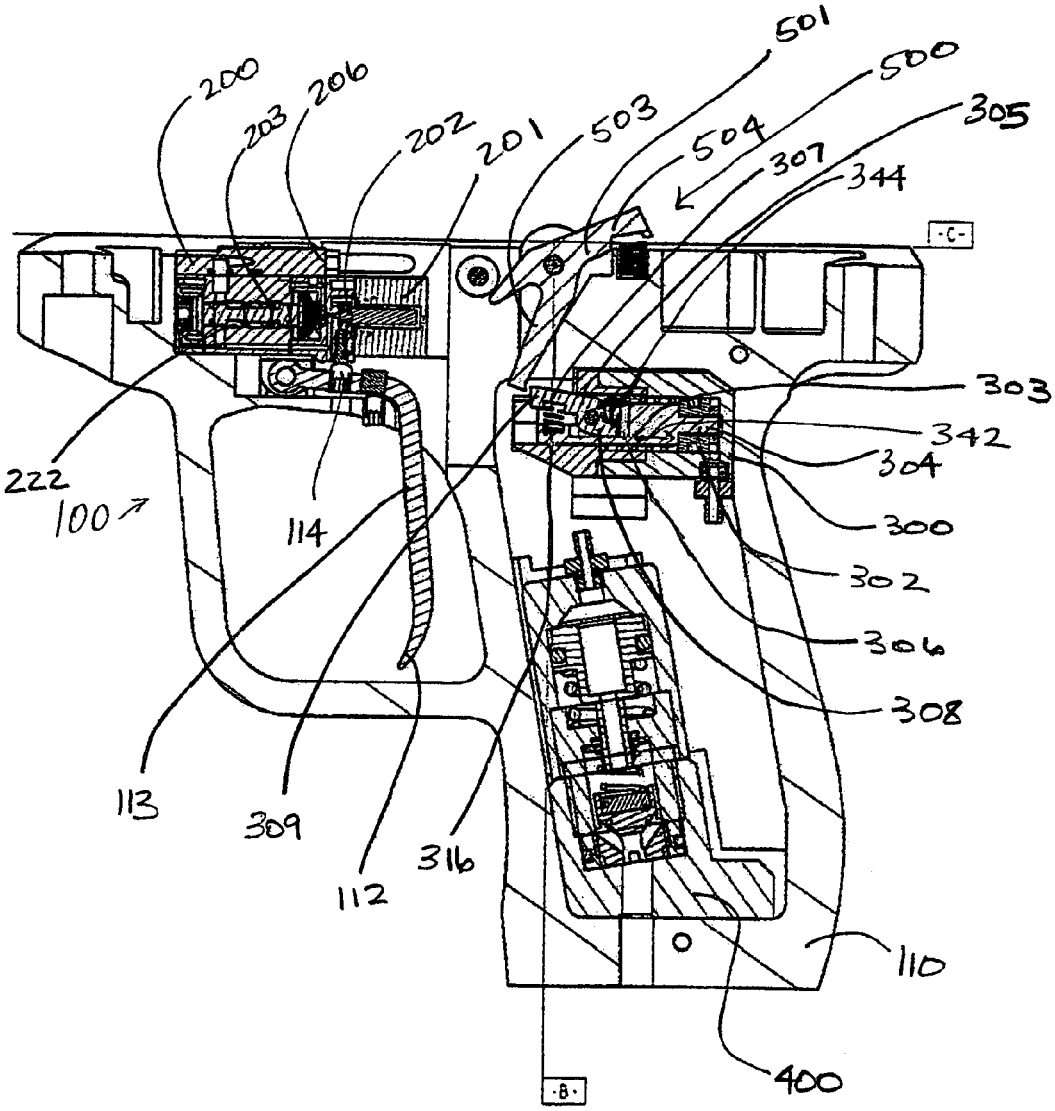
FIG. 2 displays a schematic view of the left side of the new trigger assembly.
Figure 3:
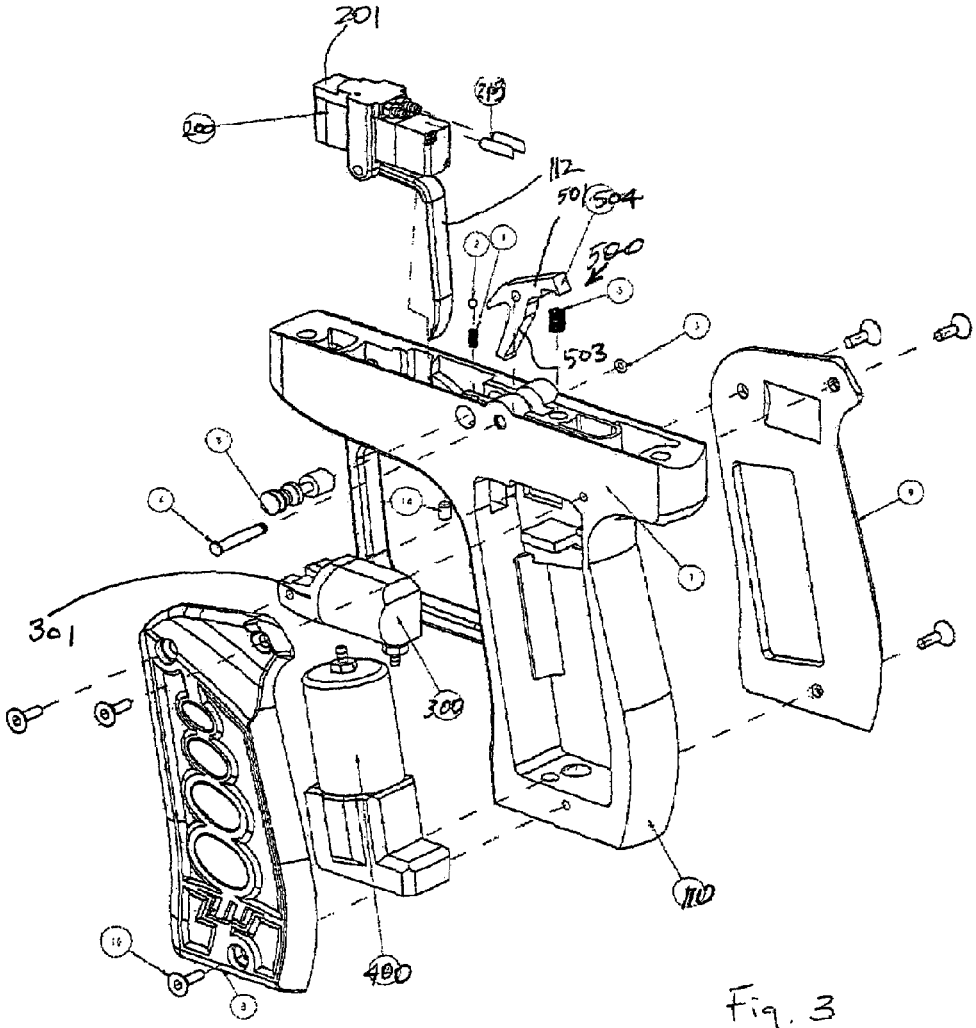
FIG. 3 displays an exploded view of the trigger assembly.

FIG. 2 is a schematic drawing of the trigger assembly 100 showing the air assist trigger assembly 200, the ram assembly 300, the secondary regulator 400, and the sear assembly 500. FIG. 3 is an exploded view of the trigger assembly 100 showing the placement of the air assist trigger 200, the ram assembly 300, the secondary regulator 400 and the sear assembly 500 within the trigger frame 110.

During operation of the paintball marker, the pressurized gas system (not shown) releases high pressure gas to the primary regulator (not shown) and low pressure gas to the secondary regulator 400. The high pressure gas, approximately 450 psi, is utilized to fire the paintball from the breech. The low pressure gas, approximately 90 to 120 psi, is utilized by the air assist trigger assembly 200 and the ram assembly 300.

The air assist trigger assembly 200 is located above the trigger 112. In an alternative embodiment, shown in FIGS. 2 and 3, the trigger 112 is connected to the air assist assembly 200. The air assist assembly 200 features a mechanical three-way valve 201. As shown in FIGS. 2 and 3, the three-way valve 201 is a modified electronic Humphreys valve (HEB10A3-GL-D7). For the present invention, the three-way valve 201 has been stripped of its electronic elements to function as a mechanical valve. The three-way valve assembly 201 is closed in its resting state. Upon movement of the trigger 112, the valve assembly 201 is motivated to open to allow the flow of low pressure gas to flow within the valve 201 through the valve intake port 206. The trigger 112 features a motivating member 114 protruding from the trigger arm 113. When the trigger 112 is pressed backward to fire a paintball, the motivating member 114 is pushed upward to bias a spring button 202 of the air assist assembly 200. The spring button 202 is pushed upward into the air assist assembly 200 to open the three-way valve 203. The internal piston 222 of the three-way valve 201 moves in an extending direction. Upon forward movement of the trigger 112, the spring button 202 is released downward, thus closing the three-way valve 203. The low pressure gas is then released through an exhaust system 213, releasing low pressure gas to motivate the ram assembly. The internal piston 222 is then allowed to return to its resting position.

The ram assembly 300 is located below the sear assembly 500 within the trigger frame 110. The ram assembly 300 features a housing 301 with a central aperture 302, an internal piston 303, a first side chamber 304, a second side chamber 306, a first side valve 310, and a sear engaging assembly 305. Upon exhaust from the air assist assembly 200, the ram assembly 300 receives low pressure gas via a first gas input 311 of the first side valve 310.

The housing 301 of the ram assembly 300 form a central aperture 302 with an internal piston 303 dividing the central aperture 302 into a first side chamber 304 and a second side chamber 306. The internal piston 303 is sealed to the wall of the internal aperture 302 by a piston seal 324.

The introduction of the compressed gas to the first gas input 311 of the first side valve 310 results in movement of the internal piston 303 towards the second end of the ram assembly 300 which we call a second direction movement 342. Because the piston 303 is sealed to the wall of the housing 301, this results in the initial formation of a slight second side chamber compression resistance 344. The second side chamber 306 houses the sear engaging assembly 305, and upon the presence of second side chamber compression 344, the sear lever 307 of the sear engaging assembly 305 biased. The sear lever 307, as shown in FIG. 2, is an S-shaped lever with a first leg 308 and a second leg 309. Upon compression within the second side chamber 306, the first leg 308 is motivated forward toward the front of the second side chamber 306 and the front of the trigger assembly. This forward movement of the first leg 308 motivates the second leg 309 downward biasing a spring 316 of the sear engaging assembly 305. With the second leg 309 biased downward, the lower leg 503 of the sear 501 is allowed to move rearward to rest above the second leg 309 of the sear lever 307. This rearward movement, in turn, motivates the upper leg 504 of the sear 501 upward, engaging the hammer of the paintball marker. The second side chamber exhaust 346 is adapted to release the remaining resistance 344. Upon return movement of the sear 501 directly after firing of the paintball marker, the sear lever 307 is returned to its original upward position by means of the spring 316.

From the foregoing, it will be seen that this invention well adapted to obtain all the ends and objects herein set forth, together with other advantages which are inherent to the structure. It will also be understood that certain features and subcombinations are of utility and may be employed without reference to other features and subcombinations. This is contemplated by and is within the scope of the claims. Many possible embodiments may be made of the invention without departing from the scope thereof. Therefore, it is to be understood that all matter herein set forth or shown in the accompanying drawings is to be interpreted as illustrative and not in a limiting sense.

What is claimed is:

1. A trigger assembly for a paintball marker utilizing a compressed gas system, the trigger assembly comprising:

a trigger frame;

a trigger;

a ram apparatus for use with compressed gas, the ram apparatus comprising:

a housing defining a central aperture;

an internal piston defining a first side chamber and a second side chamber, the internal piston movably sealed within the central aperture such that introduction of the compressed gas to the first side chamber creates movement that results in second side chamber compression; and a sear engaging assembly proximate to the first side chamber, the sear engaging assembly having a sear lever adapted to motivate a sear of the paintball marker in response to the movement of the internal piston to engage a hammer of the paintball marker.

2. The trigger assembly of claim 1, further comprising:

an air system assembly proximate to the trigger, the air system assembly having a valve fluidly coupled to the compressed gas system.

3. The apparatus of claim 2, the trigger having a motivating member adapted to bias the air system assembly valve upon rearward movement of the trigger.

4. The apparatus of claim 3, the motivating member adapted to open the air assembly valve to receive gas from the compressed gas system.

5. The apparatus of claim 4, the air system assembly having a valve fluidly connected to the ram apparatus.

6. The apparatus of claim 5, the air system assembly valve adapted to release gas upon the return movement of the trigger.

7. The apparatus of claim 1, the sear engaging assembly further comprising a spring.

8. The apparatus of claim 1, the ram assembly having a first side valve further comprising:

a first gas input, wherein the first side valve is adapted to flowably connect the first side chamber to the first gas input.

9. A trigger assembly for a paintball marker utilizing a compressed gas system, the trigger assembly comprising:

a trigger frame;

a trigger;

a ram apparatus for use with compressed gas, the ram apparatus comprising:

a housing defining a central aperture;

an internal piston defining a first side chamber and a second side chamber, the internal piston movably sealed within the central aperture such that introduction of the compressed gas to the first side chamber creates movement that results in second side chamber compression; and a sear engaging assembly proximate to the first side chamber, the sear engaging assembly having a sear lever adapted to motivate a sear of the paintball marker in response to the movement of the internal piston to engage a hammer of the paintball marker, an air system assembly proximate to the trigger, the air system having a valve fluidly coupled to the compressed gas system and fluidly connected to the ram apparatus.

10. The apparatus of claim 9, the trigger having a motivating member adapted to bias the air system assembly valve upon rearward movement of the trigger.

11. The apparatus of claim 10, the motivating member adapted to open the air assembly valve to receive gas from the compressed gas system.

12. The apparatus of claim 11, the air system assembly valve adapted to release gas upon the return movement of the trigger.

13. The apparatus of claim 9, the sear engaging assembly further comprising a spring.

* * * * *